United States Patent [19]

Lucey

[11] 4,193,739

[45] Mar. 18, 1980

[54] DEVICE FOR TURNING THE ROTOR OF A GAS TURBINE ENGINE

[75] Inventor: Desmond C. Lucey, Avon, England

[73] Assignee: Rolls-Royce Limited, London, England

[21] Appl. No.: 908,454

[22] Filed: May 22, 1978

[30] Foreign Application Priority Data

Jun. 2, 1977 [GB] United Kingdom ..... 23407/77

[51] Int. Cl.[2] ..... F01D 25/34

[52] U.S. Cl. ..... 415/118; 60/39.14 M; 415/123; 415/167; 73/116

[58] Field of Search ..... 415/118, 123, 201, 116, 415/117, 167; 60/39.14 M, 223

[56] References Cited

U.S. PATENT DOCUMENTS

| | | | |
|---|---|---|---|
| 2,749,023 | 6/1956 | Lewis | 60/39.14 M |
| 3,238,721 | 3/1966 | Brandes et al. | 415/116 |

FOREIGN PATENT DOCUMENTS

| | | | |
|---|---|---|---|
| 839925 | 6/1960 | United Kingdom | 60/39.14 M |

*Primary Examiner*—Everette A. Powell, Jr.
*Assistant Examiner*—A. N. Trausch, III
*Attorney, Agent, or Firm*—Stevens, Davis, Miller & Mosher

[57] ABSTRACT

A device for turning the rotor of a gas turbine engine for purposes of inspection has a tubular rod projecting through the casing of the engine into proximity with rotor blades of the engine. The rod has a nozzle directing a jet of air onto the blades to turn the rotor. The rod is movable axially so that when it is desired to stop the rotor the free end of the rotor engages an annular surface of the rotor to exert a braking force thereon. The rod moves under the action of a spring. Air to the nozzle is supplied through a hand-operated valve and the air supply is taken through a cylinder having a piston connected to the rod. The arrangement is such that when the valve is opened to feed the nozzle and turn the rotor, the air pressure moved the piston in the sense of retracting the rod from the braking position.

3 Claims, 3 Drawing Figures

21
23
15
18A
16
17
25
29
18
19
36
35
20
38
25A
13A
13
37
28
III
III
39
27
30
24
22
31
11, 11A 31
33
30
34
40
11, 11A
39

DEVICE FOR TURNING THE ROTOR OF A GAS TURBINE ENGINE

This invention relates to a device for turning the rotor of a gas turbine engine e.g. for the purpose of inspecting the turbine blades of the engine.

In this connection it is the practice to insert an optical viewing device through an aperture in a casing of the engine to be able to view the said blades, and to turn the rotor slowly so that the blades are seen in succession at the viewing device. For effecient working it is necessary for the operator to have good control over the turning and stopping of the rotor so that when a faulty blade is seen the operator can easily stop the rotor. It is an object of this invention to provide a turning device providing such control.

According to this invention there is provided a device for turning a rotor of a gas turbine engine comprising a member insertable through an aperture in the casing of the engine into a position adjacent blades provided on the rotor, said member including means for directing a pressurised gas on to said blades so as to cause rotation of said rotor, and means for urging said member into friction engagement with the rotor for stopping thereof.

The device may comprise a cylinder connectable to a source of compressed air, a piston contained within the cylinder and dividing the cylinder into first and second chambers, the cylinder having an end wall at said first chamber, a tubular rod secured to the piston and extending axially slidably through said end wall, a valve openable to admit air from said source to said first chamber, an inlet port in said rod for admitting air from said first chamber to the interior of the rod, a lateral nozzle provided in said rod exteriorly of the cylinder, a pad of friction material provided at the free end of the rod, compressed air admitted into the first chamber on opening of the valve exerting on the piston a first force urging the piston toward the second chamber, means for applying a second force in opposition to said first force thereby to urge the piston toward the first chamber when said first force ceases on closing of said valve.

Also according to this invention the last-describe device is provided in combination with a gas turbine engine having a rotor including an annular surface, radial aerofoil blades adjacent said surface and a casing enclosing said rotor, wherein said cylinder of the device is secured to said casing and said casing has an aperture through which said rod extends into a position in which said nozzle is situated adjacent said blades and a jet of air emerging from said nozzle can act on the blades to turn the rotor, and wherein said pad of friction material is situated adjacent said annular surface to brake the rotor on occurrance of said second force.

In operation, the second force normally acts to apply a braking force to the rotor. When the valve is operated to introduce air pressure into said first chamber to turn the rotor, said air pressure acts on the piston to exert said first force to free the rotor for rotation. When the valve is operated to shut off said air pressure the second force immediately acts to stop the rotor. In this way satisfactory control over stopping and starting the rotor is attained.

An embodiment of this invention will now be described with reference to the accompanying drawings wherein.

Figure 1:
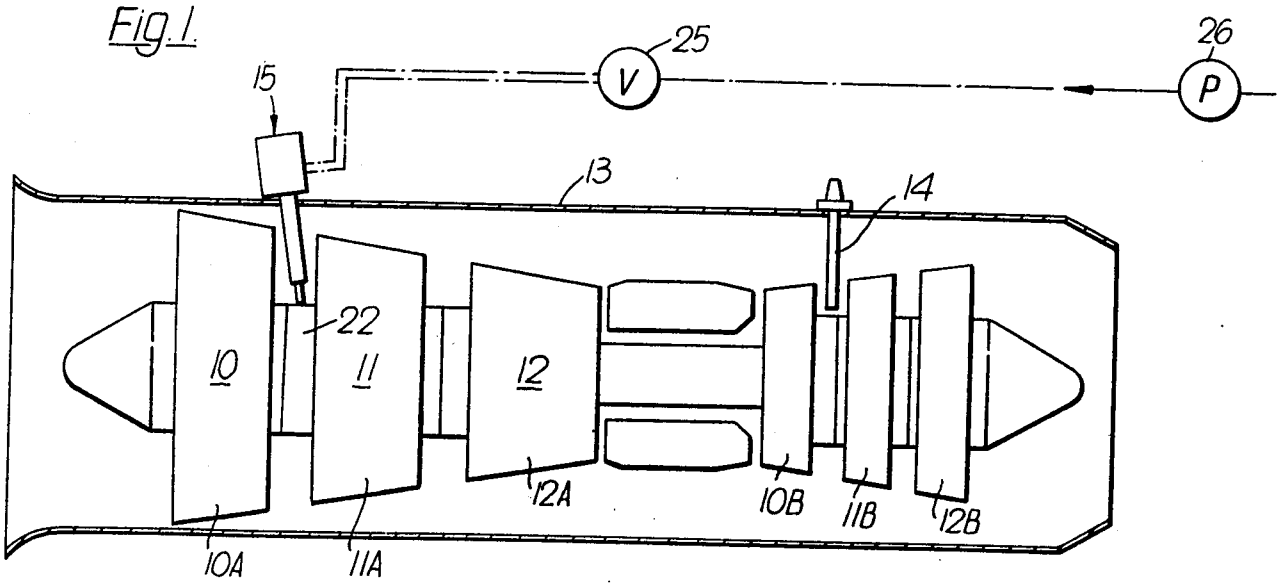
FIG. 1 is a diagrammatic illustration of a gas turbine engine and a device for turning the rotor of the engine.

The engine (FIG. 1) comprises three spools or rotors 10,11,12 enclosed by a casing 13. Each rotor comprises a compressor-turbine aggregate 10A,10B; 11A,11B; and 12A,12B. While, for purpose of being turned, the first and third rotors 10,12 are usually accessible from outside the casing, the intermediate rotor 11 is not easily accessible. The invention is particularly useful for, though of course not limited to, turning the rotor 11. FIG. 1 shows an optical viewing device or boroscope 14 in position for inspection of blades of the turbine 11B. For the purpose of such inspection, the turbine 11B is turned by the device, denoted 15, acting on the compressor 11A.

Figure 2:
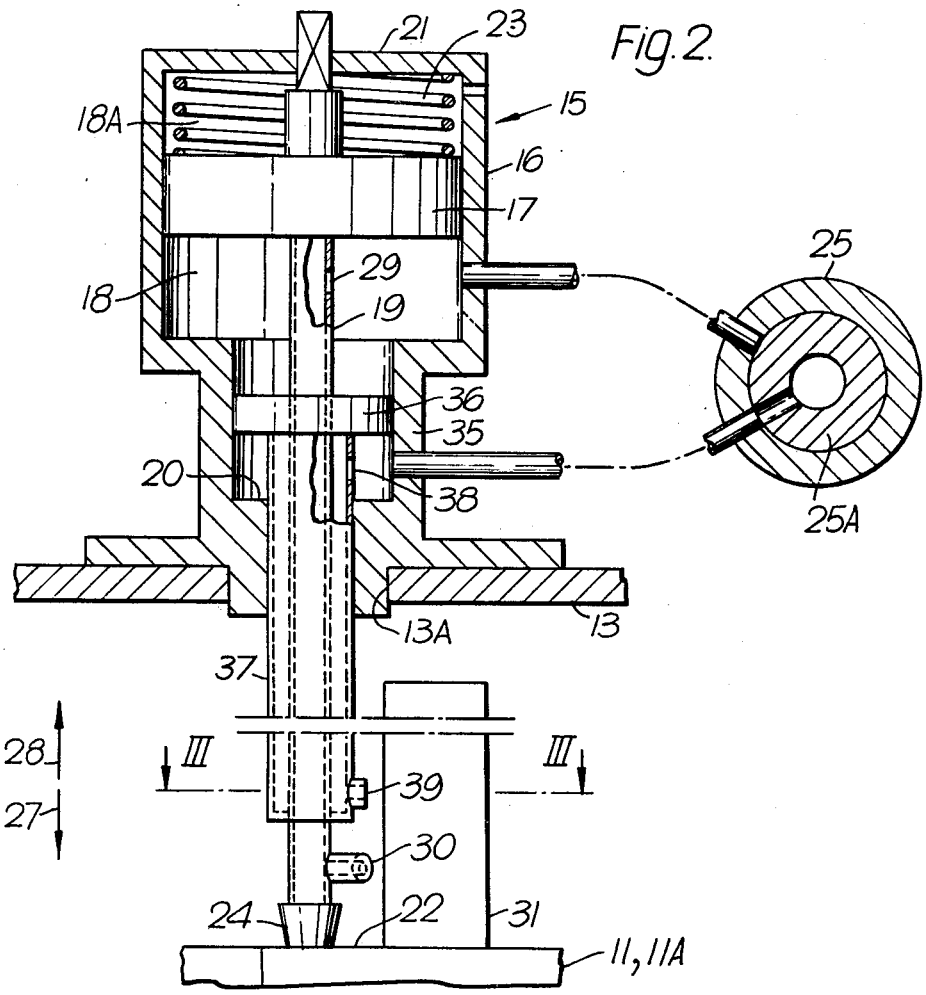
FIG. 2 is an enlarged and sectional view of the device.

The device 15 (FIG. 2) comprises a cylinder 16 having end walls 20,21. A piston 17 in the cylinder 16 divides the cylinder into a first chamber 18 and a second chamber 18A. A tubular rod 19 secured to the piston 17 extends axially slidably through the end wall 20 to the exterior of the cylinder 16. The cylinder is releasably secured to the outside of the casing 13 and the rod 17 extends through an aperture 13A in the casing substantially radially in respect of an annular surface 22 of the rotor 11A. The chamber 18A, which is open to atmosphere, contains a spring 23 acting on the piston 17 to press a friction pad 24 provided at the free end of the rod 19 against the surface 22 thereby to provide on the rotor a braking force 27 opposing rotation of the rotor. The pad is made of a suitable friction material e.g. rubber.

Figure 3:
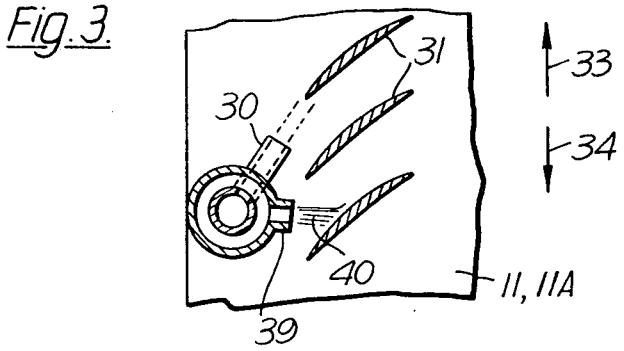
FIG. 3 is a section on the line III—III in FIG. 2.

When it is desired to turn the rotor, a manually operated valve 25 is operated to admit compressed air from a pump 26 to the first chamber 18 of the cylinder. The resulting rise in pressure in the chamber 18 creates on the piston 17 a release force 28 opposing the braking force 27 applied by the spring so that the pad 24 is lifted from the surface 22 and the rotor becomes free to be turned. Simultaneously, the air passes through an inlet port 29 provided in the rod inside the chamber 18 and issues from a lateral outlet port or nozzle 30 provided in the rod outside the cylinder. The air issues from the nozzle 30 in the form of a jet 32 acting on adjacent aerofoil blades 31 of the rotor to turn the latter. A non-circular extension 32 of the piston prevents rotation thereof so that the nozzle 30 is kept at the angle at which the jet 32 act on the blades 31 to turn the rotor in the one direction 33 of rotation, (FIG. 3).

For the purpose of turning the rotor in the opposite direction 34 of rotation the device includes a second cylinder 35 containing a second piston 36 secured to the rod 19. A sleeve 37 surrounding the rod 19 with clearance therebetween has an inlet port 38 inside the second cylinder 35 and an outlet port or nozzle 39 situated adjacent the nozzle 30 of the rod 19 but at an angle whereby a jet 40 issuing from the nozzle 39 turns the rotor 11A in the direction 34. The valve 25 has a valve member 25A settable for directing the air supply selectively to either the cylinder 16 or to the cylinder 35. The friction pad 24 is released by air pressure on the piston 36 in the same way as was described in respect of the piston 17.

It will be seen that the valve 25 can be operated to turn the rotor in either direction of rotation, and that when the valve is set to shut-off the supply to either cylinder 16,35 the rotor is stopped by action of the pad 24.

I claim:

1. Device for turning a rotor of a gas turbine engine comprising an engine casing a member insertable through an aperture in said casing of said engine into a position adjacent blades provided on the rotor, said member including means for directing a pressurised gas on to said blades so as to cause rotation of said rotor, and means for urging said member into friction engagement with the rotor for stopping thereof.

2. A gas turbine engine including a rotor, a device for turning said rotor comprising a cylinder connectable to a source of compressed air, a piston contained within the cylinder and dividing the cylinder into first and second chambers, the cylinder having an end wall at said first chamber, a tubular rod secured to the piston and extending axially slidably through said end wall, a valve openable to admit air from said source to said first chamber, an inlet port in said rod for admitting air from said first chamber to the interior of the rod, a lateral nozzle provided in said rod exteriorly of the cylinder, a pad of friction material provided at the free end of the rod, compressed air admitted into the first chamber on opening of the valve exerting on the piston a first force urging the piston toward the second chamber, means for applying a second force in opposition to said first force thereby to urge the piston toward the first chamber when said first force ceases on closing of said valve.

3. Device according to claim 2 in combination with a gas turbine engine, the engine having a rotor including an annular surface, radial aerofoil blades adjacent said surface and a casing enclosing said rotor, wherein said cylinder of the device is secured to said casing and said casing has an aperture through which said rod extends into a position in which said nozzle is situated adjacent said blades and a jet of air emerging from said nozzle can act on the blades to turn the rotor, and wherein said pad of friction material is situated adjacent said annular surface to brake the rotor on occurrance of said second force.

* * * * *